US008876263B2

(12) United States Patent
Sasagawa et al.

(10) Patent No.: US 8,876,263 B2
(45) Date of Patent: Nov. 4, 2014

(54) LIQUID EJECTION HEAD

(71) Applicant: Canon Kabushiki Kaisha, Tokyo (JP)

(72) Inventors: Naoto Sasagawa, Kawasaki (JP); Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/916,981

(22) Filed: Jun. 13, 2013

(65) Prior Publication Data

US 2013/0342615 A1 Dec. 26, 2013

(30) Foreign Application Priority Data

Jun. 22, 2012 (JP) ..... 2012-140844

(51) Int. Cl.
*B41J 2/045* (2006.01)
*B41J 2/14* (2006.01)

(52) U.S. Cl.
CPC ..... *B41J 2/14201* (2013.01); *B41J 2/14209* (2013.01)
USPC ..... 347/71; 347/68

(58) Field of Classification Search
None
See application file for complete search history.

(56) References Cited

U.S. PATENT DOCUMENTS

| | | | | |
|---|---|---|---|---|
| 5,252,994 | A * | 10/1993 | Narita et al. | 347/71 |
| 5,901,425 | A * | 5/1999 | Bibl et al. | 29/25.35 |
| 6,188,416 | B1 * | 2/2001 | Hayes | 347/71 |
| 8,191,994 | B2 | 6/2012 | Nakakubo et al. | |
| 8,517,518 | B2 | 8/2013 | Kashu et al. | |
| 8,622,519 | B2 * | 1/2014 | Watanabe | 347/44 |
| 2013/0093819 | A1 | 4/2013 | Nakakubo et al. | |
| 2013/0162725 | A1 | 6/2013 | Suzuki et al. | |

FOREIGN PATENT DOCUMENTS

JP 2007-168319 A 7/2007

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head has a plurality of pressure chambers communicating with respective ejection ports and a plurality of hollow spaces arranged around the pressure chambers in a piezoelectric block which is produced by laminating a plurality of piezoelectric plates made of a piezoelectric material. Each of the plurality of piezoelectric plates has a plurality of first grooves on a first surface and a plurality of second grooves on a second surface opposite to the first surface. The plurality of piezoelectric plates are laminated so as to put the first surfaces or the second surfaces of adjacent piezoelectric plates into contact with each other such that the pressure chambers are formed as the first grooves of the paired first surfaces are placed vis-a-vis and the hollow spaces are formed as the second grooves of the paired second surfaces are placed vis-à-vis.

10 Claims, 13 Drawing Sheets

LIQUID EJECTION HEAD

BACKGROUND OF THE INVENTION

1. Field of the Invention

The present invention relates to a liquid ejection head for ejecting liquid.

2. Description of the Related Art

An inkjet recording apparatus designed to eject ink and record an image on a recording medium generally includes a liquid ejection head mounted therein to eject ink. Mechanisms employing pressure chambers whose capacities can be expanded and contracted by means of piezoelectric elements are known as mechanisms for causing a liquid ejection head to eject ink. With such a mechanism, as each of the piezoelectric elements is deformed due to the voltage applied thereto, the related pressure chamber is contracted to eject ink in the pressure chamber from an ejection port formed at an end of the pressure chamber. As a type of liquid ejection head having such a mechanism, shear mode type liquid ejection heads having pressure chambers, each having one or two inner wall surfaces formed by using so many piezoelectric elements, are known. Such a shear mode type liquid ejection head is designed to contract each of the pressure chambers by shear deformation of the piezoelectric elements of the pressure chamber unlike instances where piezoelectric elements are subjected to contraction deformation and expansion deformation.

Inkjet recording apparatus for industrial applications are required to be able to use high viscosity liquid. For a liquid ejection head to eject high viscosity liquid, the ejection head is required to provide a large ejection force. So-called Gould type liquid ejection heads including pressure chambers each of which is formed by using a cylindrical piezoelectric member representing a circular or rectangular cross section have been proposed to meet the requirement. A Gould type liquid ejection head is so designed that each of the pressure chambers is expanded and contracted as the piezoelectric member is deformed by expansion and contraction respectively in inward and outward directions (radial directions) relative to the center of the pressure chamber. In a Gould type liquid ejection head, all the wall surfaces of each pressure chamber are deformed and the deformations boost the ejection force of the liquid ejection head. Therefore, Gould type liquid ejection heads can provide a larger liquid ejection force if compared with shear mode type liquid ejection heads in which one or two wall surfaces of each of the pressure chambers are formed by using piezoelectric elements.

For a Gould type liquid ejection head to provide a higher resolution, a plurality of ejection ports need to be arranged highly densely. Then, as a result, pressure chambers that correspond to the respective ejection ports need to be arranged highly densely. Japanese Patent Application Laid-Open No. 2007-168319 discloses a method of manufacturing a Gould type liquid ejection head in which pressure chambers can be formed highly densely.

With the manufacturing method disclosed in Japanese Patent Application Laid-Open No. 2007-168319, firstly a plurality of grooves that extend in the same direction are formed for each piezoelectric plate. Subsequently, the plurality of piezoelectric plates are aligned in terms of the directions of their grooves and laid one on the other. The piezoelectric plates are then cut in a direction perpendicular to the running direction of the grooves. The groove parts of the cut piezoelectric plates constitute inner wall surfaces of pressure chambers. Thereafter, the piezoelectric member existing between any adjacently located pressure chambers is removed to a certain depth in order to separate the pressure chambers. Then, a supply channel plate and an ink pool plate, and a printed circuit board and a nozzle plate are connected respectively to the top and to the bottom of the piezoelectric plates having complete pressure chambers to produce a complete liquid ejection head. With this manufacturing method, pressure chambers can be arranged into a matrix of pressure chambers. In other words, pressure chambers can be arranged highly densely. Additionally, with this manufacturing method, pressure chambers can be formed highly accurately because forming grooves in piezoelectric plates ensures a better machinability than cutting holes in piezoelectric plates.

The pressure chambers of a liquid ejection head manufactured by the method disclosed in Japanese Patent Application Laid-Open No. 2007-168319 are separated from each other by spaces. In other words, the wall sections of each of the pressure chambers are formed independently. Then, as a result, the liquid ejection head cannot secure a satisfactory level of rigidity particularly when the pressure chambers are made long (high) for the purpose of ejecting highly viscous liquid (in other words for the purpose of providing a large force for ejecting liquid). As the rigidity of the liquid ejection head falls, the structures (walls) forming the pressure chambers become easily breakable so that they can easily give rise to a situation where liquid can no longer be ejected.

SUMMARY OF THE INVENTION

In view of the above-identified problem, an object of the present invention is to provide a liquid ejection head having an enhanced rigidity at and around the pressure chambers thereof.

According to the present invention, the above object of the invention is achieved by providing a liquid ejection head including: a plurality of pressure chambers communicating with respective ejection ports for ejecting liquid and arranged to store liquid to be ejected from the ejection ports, the wall section of each of the pressure chambers being formed by means of a piezoelectric material; and a plurality of hollow spaces arranged around the pressure chambers and separated from the pressure chambers by gaps, wherein the pressure chambers and the hollow spaces are formed in a piezoelectric block produced by laminating a plurality of piezoelectric plates made of a piezoelectric material, a plurality of first grooves being formed on a first surface of each of the piezoelectric plates so as to extend in a first direction, a plurality of second grooves being formed on a second surface opposite to the first surface of each of the piezoelectric plates so as to extend in the first direction; the plurality of piezoelectric plates are laminated so as to put the first surfaces or the second surfaces of adjacent piezoelectric plates into contact with each other such that the pressure chambers are formed as the first grooves of the paired first surfaces that are held in contact with each other are placed vis-a-vis, and the hollow spaces are formed as the second grooves of the paired second surfaces that are held in contact with each other are placed vis-a-vis; and first electrodes are formed in the first grooves, and second electrodes are formed in the second grooves.

Further features of the present invention will become apparent from the following description of exemplary embodiments with reference to the attached drawings.

DESCRIPTION OF THE EMBODIMENTS

Now, the embodiments of the present invention will be described below in greater detail by referring to the accompanying drawings.

First Embodiment

Firstly, the first embodiment of liquid ejection head according to the present invention will be described.

Figure 1:
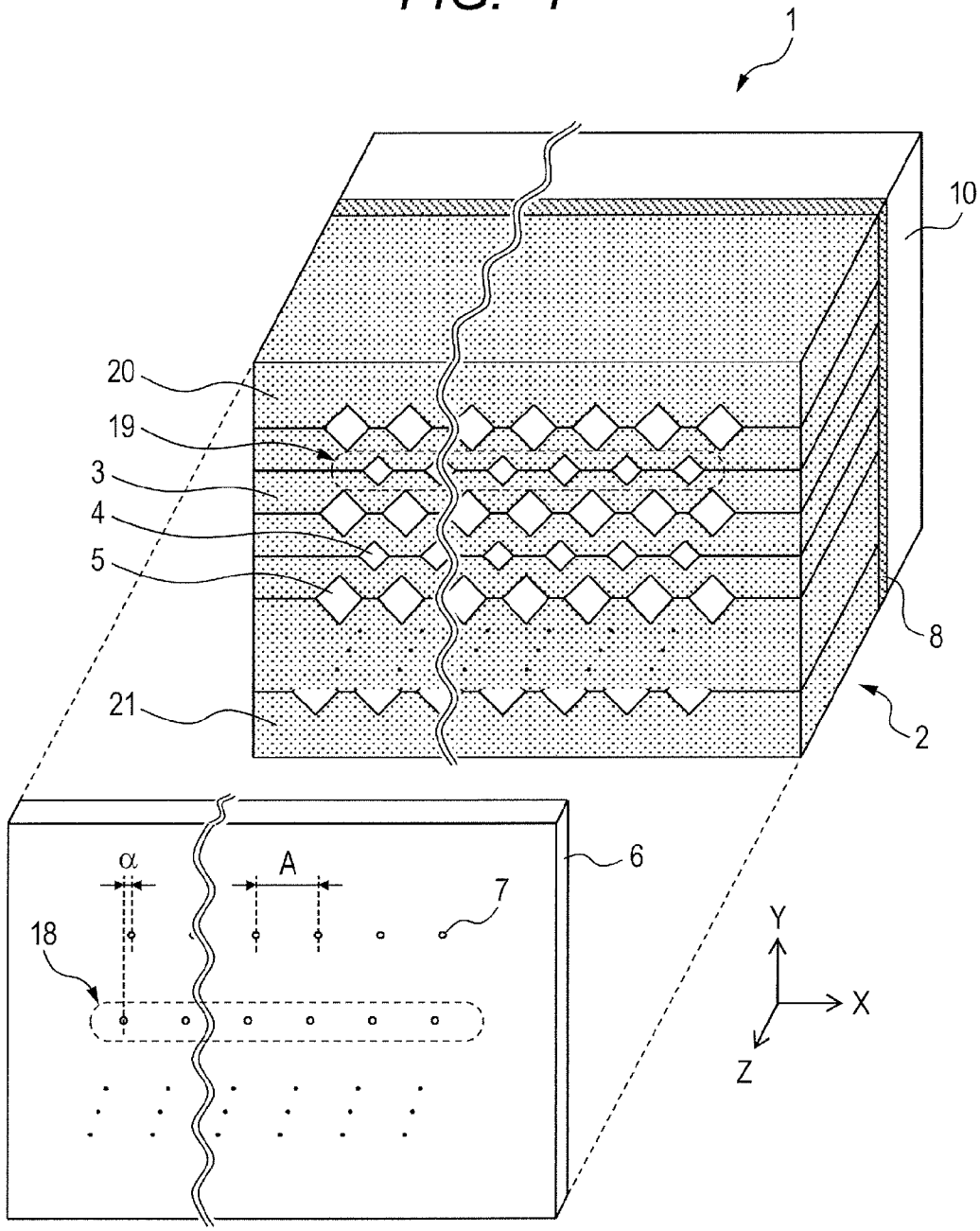
FIG. 1 is a schematic perspective view of the first embodiment of liquid ejection head according to the present invention.

FIG. 1 is a schematic perspective view of the first embodiment of liquid ejection head according to the present invention. In the following description, the direction in which liquid is supplied is referred to as Z-direction and a plane that orthogonally intersects the Z-direction is referred as X-Y plane. Then, recording mediums are conveyed in the Y-direction.

As illustrated in FIG. 1, the liquid ejection head 1 of this embodiment includes an ink pool plate 10, an aperture plate 8, a piezoelectric block 2 and a nozzle plate 6. The nozzle plate 6 is bonded to the front surface of the piezoelectric block 2. Note that, in FIG. 1, the nozzle plate 6 is separated from the piezoelectric block 2 for the purpose of easy understanding of the structure of the piezoelectric block 2. A plurality of ejection ports 7 are formed in the nozzle plate 6. The ejection ports 7 are arranged (two-dimensionally) at grid crossings that are separated by predetermined gaps. The aperture plate 8 is bonded to the back surface of the piezoelectric block 2. A plurality of apertures (not illustrated in FIG. 1) are formed in the aperture plate 8 and arranged (two-dimensionally) at grid crossings that are separated by predetermined gaps just like the ejection ports 7. The ink pool plate 10 is boned to the back surface of the aperture plate 8.

As described above, a plurality of ejection ports 7 are formed in the nozzle plate 6 to produce a plurality of ejection port rows 18 that run in the X-direction. As illustrated in FIG. 1, the ejection port rows 18 are arranged side by side in the Y-direction such that adjacent rows are displaced in a certain direction (in the X-direction) by a predetermined length a in order to raise the effective nozzle density. In this embodiment, the pitch of arrangement of ejection ports 7 of the ejection port rows 18 in the X-direction is 80 dpi (dot per inch). A total of 15 ejection port rows 18 are provided and arranged side by side in the Y-direction. An effective nozzle pitch of 1200 dpi can be realized by displacing adjacent ejection port rows 18 by 1/15 of the gap A separating adjacent ejection ports 7 in a certain direction (in the X-direction). Differently stated, $A/15=\alpha$. The effective nozzle density can be raised by increasing the number of rows of the ejection port rows 18.

Figure 2:
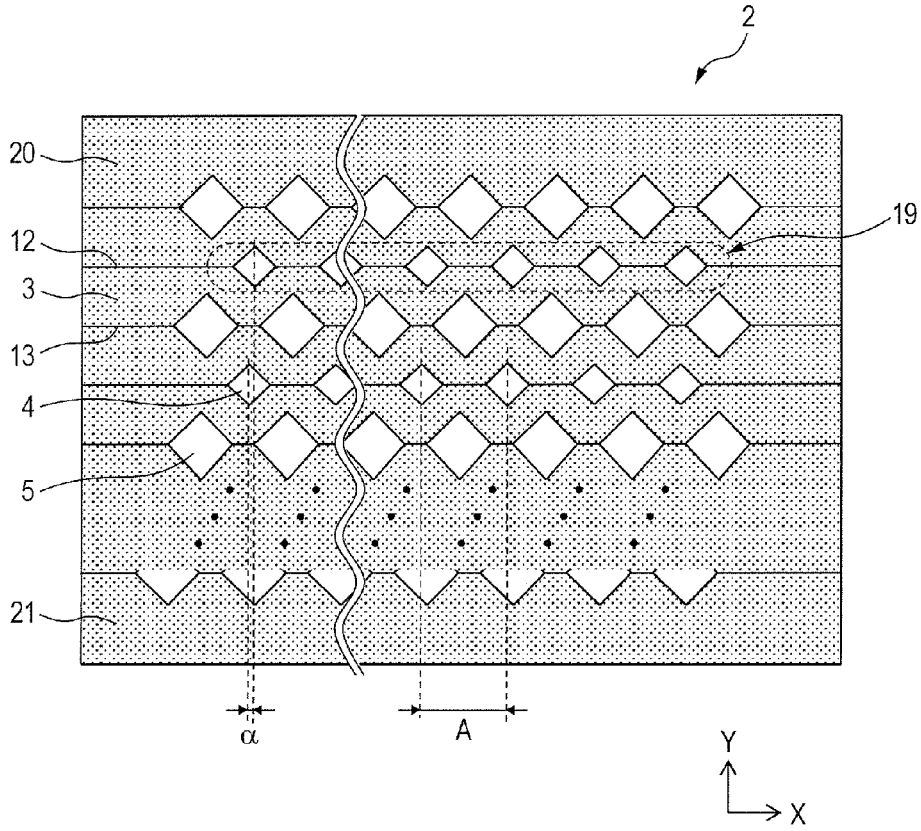
FIG. 2 is a schematic cross-sectional view of the piezoelectric block of the liquid ejection head illustrated in FIG. 1 taken along an X-Y plane.

FIG. 2 is a schematic cross-sectional view of the piezoelectric block 2 illustrated in FIG. 1 that is taken along an X-Y plane.

The piezoelectric block 2 is formed entirely by means of a piezoelectric material. As illustrated in FIG. 2, the piezoelectric block 2 is a laminated body formed by a plurality of piezoelectric plates 3 that are laid one on the other in the Y-direction and first and second end plates 20 and 21 arranged at respective ends of the laminated piezoelectric plates 3 as viewed in the direction in which the piezoelectric plates 3 are laminated (in the Y-direction).

Figure 3A:
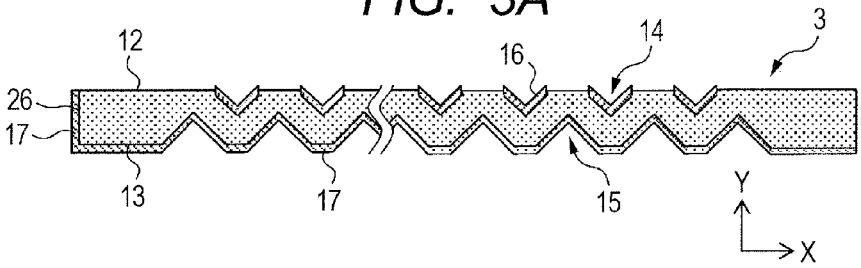
FIGS. 3A, 3B and 3C are a schematic cross-sectional view and schematic perspective views of one of the piezoelectric plates of the piezoelectric block illustrated in FIG. 2.
Figure 3B:
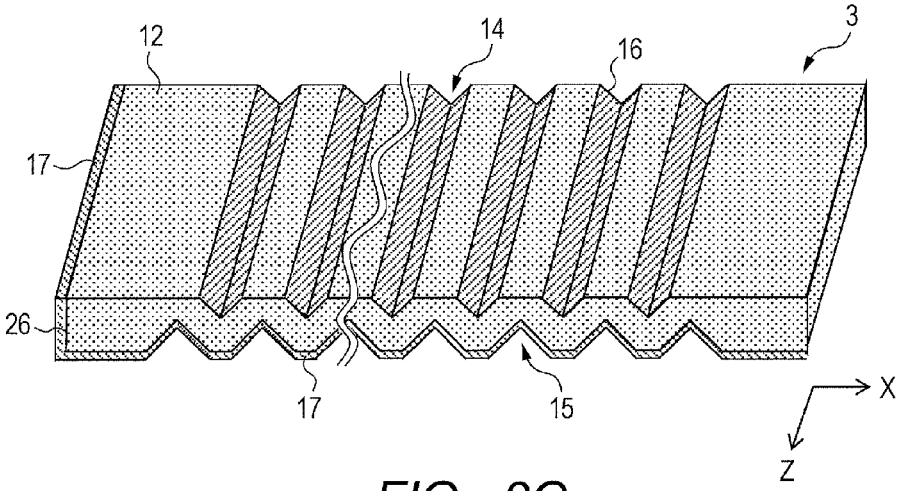
Figure 3C:
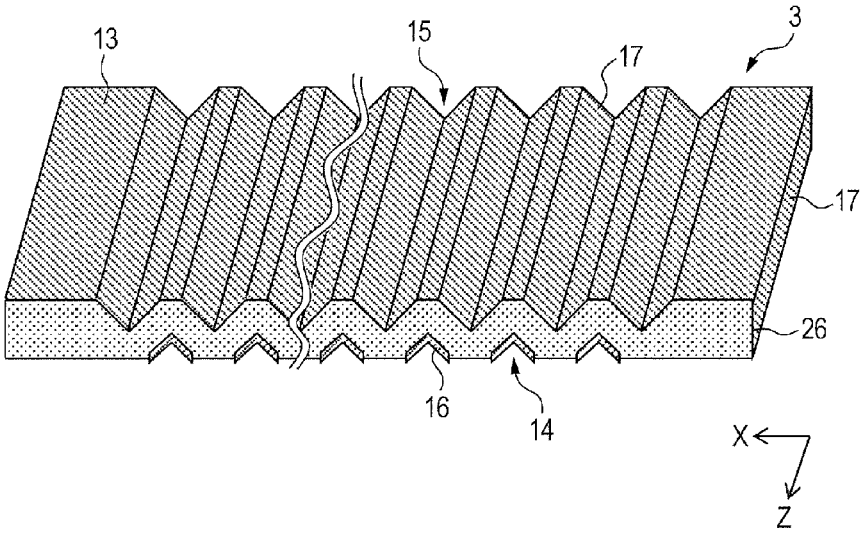

FIGS. 3A and 3B illustrate in detail the configuration of one of the piezoelectric plates 3 of the piezoelectric block illustrated in FIG. 2. FIG. 3A is a schematic cross-sectional view of the piezoelectric plate 3 taken along an X-Y plane. FIG. 3B is a schematic perspective view of the piezoelectric plate 3 as viewed from the side of the first surface 12. FIG. 3C is a schematic perspective view of the piezoelectric plate 3 as viewed from the side of the second surface 13 that is opposite to the first surface 12.

As illustrated in FIGS. 3A and 3B, a plurality of first grooves 14 are formed on the first surface 12 of the piezoelectric plate 3. All the first grooves 14 extend in the Z-direction (in the first direction) and are arranged side by side in the X-direction. As illustrated in FIGS. 3A and 3C, on the other hand, a plurality of second grooves 15 are formed on the second surface 13 of the piezoelectric plate 3. All the second grooves 15 extend in the Z-direction and are arranged side by side in the X-direction but displaced from the first grooves 14 as viewed in the Y-direction. In this embodiment, the first grooves 14 and the second grooves 15 are arranged alternately as viewed in the Y-direction.

The first grooves 14 and the second grooves 15 are formed in the piezoelectric plate 3 by grinding machining. The first grooves 14 and the second grooves 15 need to be accurately positioned respectively on the front surface and on the back surface of the piezoelectric plate 3. In this embodiment, a both sides aligner is employed and alignment marks (not illustrated) are formed in advance on the first surface 12 and the second surface 13 of the piezoelectric plate 3. The first grooves 14 and the second grooves 15 can be formed accurately in position respectively on the front surface and on the back surface of the piezoelectric plate 3 to a degree of accuracy of several micrometers by executing a grinding machining process, referring to the alignment marks.

As an example, the dimensions of each of the piezoelectric plates 3 are such that it has a width (length in the X-direction) of 26 mm, a thickness (length in the Y-direction) of 0.22 mm and a length (length in the Z-direction) of 10 mm. Each of the first grooves 14 represents a triangular cross section typically having a width of 160 μm and a depth of 80 μm, whereas each of the second grooves 15 represents a triangular cross section typically having a width of 240 μm and a depth of 120 μm.

Referring to FIG. 2 again, any two adjacently located piezoelectric plates 3 in the piezoelectric block 2 are laid one on the other such that their first surfaces 12 or their second surfaces 13 are held in contact with each other. The first grooves formed respectively on the first surfaces 12 that are held in contact with each other are arranged vis-a-vis, and as a result, pressure chambers 4 for storing liquid to be ejected from the ejection ports 7 are formed. Opening sections (hollow spaces) 5 are produced as the second grooves formed on the second surface 13 of one of the paired piezoelectric plates are arranged exactly vis-a-vis the respective second grooves formed on the second surface of the other piezoelectric plate. As a result, a plurality of rows of pressure chambers 4, each extending in the Z-direction, or pressure chamber rows 19, each extending in the X-direction, are arranged in the Y-direction and four opening sections 5 are formed around each of the pressure chambers 4 and separated from the pressure chamber 4 by a certain gap.

In this embodiment, the pressure chamber rows 19 are sequentially displaced by a predetermined length of a (see FIG. 2) in a certain direction (in the X-direction) so as to correspond to the arrangement of the ejection port rows 18 formed in the nozzle plate 6 and arranged in the Y-direction. In other words, in this embodiment, a plurality of piezoelectric plates 3 whose shapes are slightly different from each other in terms of the first grooves 14 and the second grooves 15 is employed. Therefore, each of the piezoelectric plates 3 is machined such that it is adjusted for the positions of the first grooves 14 and also for the positions of the second grooves 15.

First electrodes 16 are formed respectively in the first grooves 14 that are formed on the first surface 12 of each of the piezoelectric plates 3 as illustrated in FIGS. 3A and 3B. The first electrodes 16 are independent from each other and drawn out to the lateral surface of the piezoelectric plate 3 at the side of aperture plate 8. On the other hand, second electrodes 17 are formed respectively in the second grooves 15 that are formed on the second surface 13 of each of the piezoelectric plates 3 as illustrated in FIGS. 3A and 3C. The second electrodes 17 formed in the respective second grooves 15 are mutually linked on the second surface 13 and drawn out to the lateral surface 26 of the piezoelectric plate 3. In this embodiment, a second electrode 17 is formed on the entire surface of the second surface 13 of each of the piezoelectric plates 3, including the inner surfaces of the second grooves 15.

The pattern of the first electrodes 16 and that of the second electrodes 17 in the form of film patterns formed on the respective surfaces of each of the piezoelectric plates 3 can be prepared by photolithography. Alternatively, the first electrodes 16 and the second electrodes 17 can be formed by forming electrode layers respectively on the entire surfaces of each of the piezoelectric plates and grinding off the surfaces of the piezoelectric plate, leaving only the necessary parts of the electrode layers unground.

A polarization process is executed on each of the piezoelectric plates 3 after forming the first grooves 14, the second grooves 15, the first electrodes 16 and the second electrodes 17 on the piezoelectric plate 3. The polarization process is executed by applying an electric field of 2 kV/mm between the first electrodes 16 and the second electrodes 17, while the piezoelectric plate 3 is immersed in silicon oil at 200° C.

After executing a polarization process on each of the piezoelectric plates 3, a plurality of piezoelectric plates 3 are laid one on the other and bonded to each other by means of an adhesive agent to produce a piezoelectric block 2. When laminating the piezoelectric plates 3, the pressure chambers 4 and the opening sections 5 can be formed accurately in position by accurately laying the piezoelectric plates 3 one on the other, referring to the above-described alignment marks.

After forming the piezoelectric block 2, the nozzle plate 6 and the aperture plate 8 are bonded to the piezoelectric block 2 by means of an adhesive agent and then the ink pool plate 10 is bonded to the aperture plate 8. As a result, the ink pool 11 is held in communication with the apertures 9, the pressure chambers 4 and the ejection ports 7 (see FIG. 10).

Figure 4A:
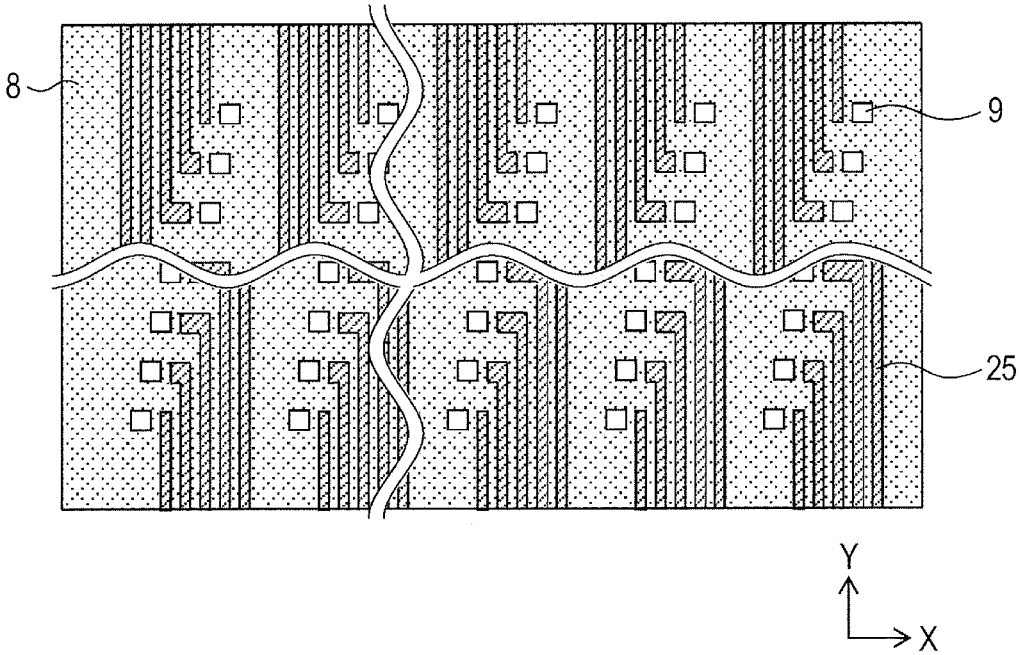
FIGS. 4A and 4B are a schematic plan view of the aperture plate of the first embodiment of liquid ejection head according to the present invention and a schematic cross-sectional view of first embodiment, illustrating the electric connection between the aperture plate and the piezoelectric block.
Figure 4B:
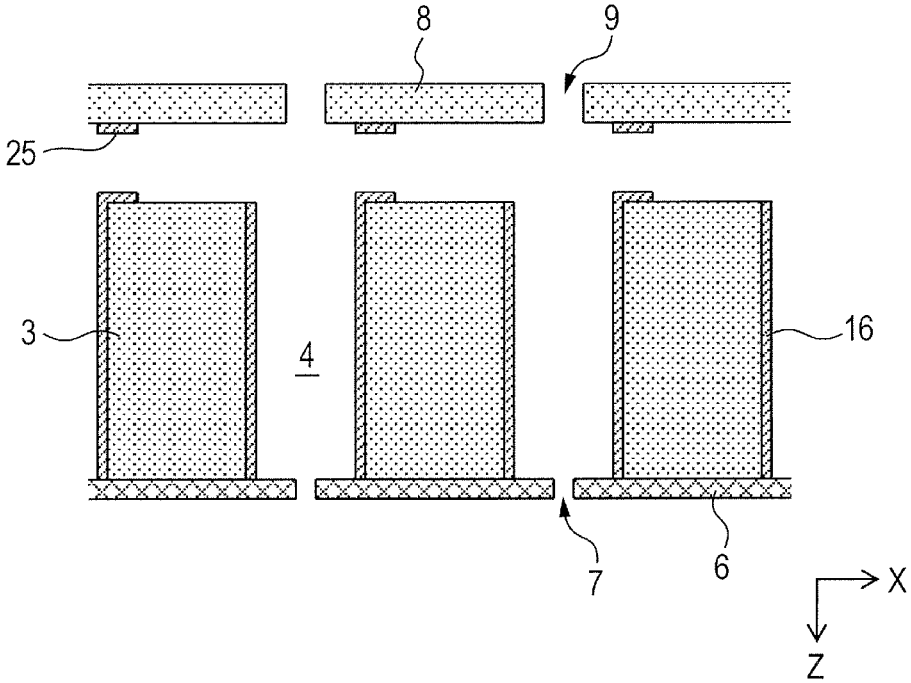

FIG. 4A is a schematic plan view of the aperture plate 8 of this embodiment as viewed from the side thereof to be bonded to the piezoelectric block 2. FIG. 4B is a schematic cross-sectional view of the liquid ejection head taken along a Z-X plane, the aperture plate 8 being separated from the piezoelectric block 2 in order to illustrate how the aperture plate wirings 25 and the first electrodes 16 are connected.

As illustrated in FIG. 4A, the aperture plate wirings 25 are formed by patterning so as to make each of the aperture plate wirings 25 correspond to the corresponding one of the apertures 9. Each of the aperture plate wirings 25 is drawn out to the lateral surface located close to the corresponding aperture 9 as viewed in the Y-direction in order to realize a high density wiring arrangement.

Now, how the aperture plate wirings 25 and the first electrodes 16 are connected will be described below by referring to FIG. 4B.

The first electrodes 16 drawn out from each of the piezoelectric plates 3 are respectively connected to the aperture plate wirings 25 formed on the aperture plate 8. In this embodiment, a pressure chamber 4 is formed by two first grooves 14 formed in a pair of adjacently located piezoelectric plates 3. Therefore, each of the first electrodes 16 formed on the paired piezoelectric plates 3 is connected to corresponding one of the aperture plate wirings 25 as illustrated in FIG. 4B.

The first electrodes 16 are drawn out individually from the aperture plate 8 as they are respectively connected to the aperture plate wirings 25 and signals (SIG) are individually applied to the first electrodes 16 by way of the respective aperture plate wirings 25. On the other hand, the second electrode 17 that is drawn out to the lateral surface 26 of the piezoelectric plate 3 (see FIG. 3B) and hence to the lateral surface of the piezoelectric block 2 is grounded (GND).

As described above, the configuration of this embodiment allows the electrodes to be wired with ease because the signal electrodes (SIG) and the grounding electrodes (GND) are formed respectively on the first surfaces 12 and on the second surfaces 13 of the piezoelectric plates 3.

As for the profile of the ejection ports 7, the ejection ports 7 may for example have a profile of a circular cylinder with a diameter ϕ of 10 μm and a length of 17 μm. As for the profile of the apertures 9, the apertures 9 may for example have a profile of a quadrangular prism representing a cross section of 70 μm×70 μm and a length of 200 μm.

Figure 5A:
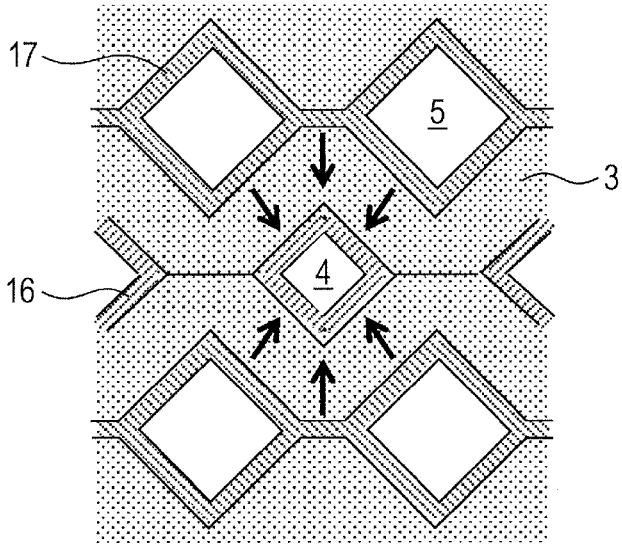
FIGS. 5A and 5B are enlarged schematic cross-sectional views of a pressure chamber and its vicinity of the piezoelectric block of the first embodiment of liquid ejection head according to the present invention.
Figure 5B:
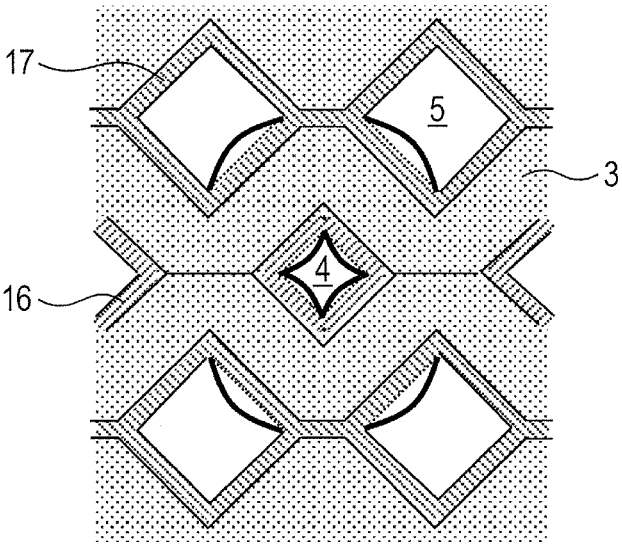

FIGS. 5A and 5B are enlarged schematic cross-sectional views of a pressure chamber 4 and its vicinity of the piezoelectric block 2 of this embodiment. FIG. 5A illustrates the electric field distribution around the pressure chamber 4 that can be observed when the liquid ejection head is driven to operate. FIG. 5B illustrates a structural deformation of the pressure chamber 4 and the surroundings thereof. In FIG. 5B, the dotted lines indicate the wall surfaces of the pressure chamber 4 before the deformation and the solid lines indicate the wall surfaces of the pressure chamber 4 after the deformation, which is exaggerated in the drawing.

As the second electrodes 17 formed on the second surfaces 13 (the inner wall surfaces of the opening sections 5) of the piezoelectric plates 3 are grounded and a positive voltage is applied to the first electrodes 16 formed on the inner wall surfaces of the pressure chambers 4, the pressure chambers 4 are subjected to contraction deformation as illustrated in FIG. 5B. As the inner wall surfaces of the pressure chambers 4 are deformed to warp toward the inside, the liquid introduced into the pressure chambers 4 from the ink pool plate 10 is ejected from the ejection ports 7.

The liquid ejection head 1 of this embodiment is so configured that the wall sections of the pressure chambers 4 and the wall sections of the opening sections 5 are mutually linked. Therefore, if compared with a structure where the wall sections of a pressure chamber are so formed as to be independent from the wall sections of the other pressure chambers, the rigidity of the pressure chambers and their vicinities can be raised. Additionally, the electrodes of the liquid ejection head 1 can be wired with ease because the signal electrodes (SIG) and the grounding electrodes (GND) are formed respectively on the first surfaces 12 and on the second surfaces 13 of the piezoelectric plates 3.

Figure 6:
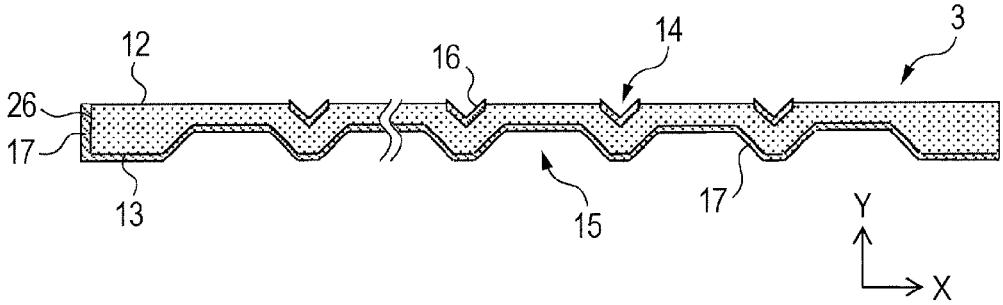
FIG. 6 is a schematic cross-sectional view of a piezoelectric plate prepared by modifying the piezoelectric plate illustrated in FIG. 3A that is taken along an X-Y plane.

FIG. 6 is a schematic cross-sectional view of a piezoelectric plate 3 prepared by modifying one of the piezoelectric plates 3 of this embodiment taken along an X-Y plane. When the pitch of arrangement of nozzles is large and hence the distance separating any adjacent pressure chambers 4 in the pressure chamber rows 19 (the gap separating adjacent first grooves 14 in the X-direction) is large, the cross section of each of the second grooves 15 may not necessarily be triangular and may alternatively be trapezoidal.

Second Embodiment

Now, the configuration of the second embodiment of liquid ejection head according to the present invention will be described below. In the following description, the components of this embodiment that are the same as or similar to those of the first embodiment are denoted by the same reference symbols and will not be described repeatedly. In other words, the second embodiment will be described only in terms of the differences between the first embodiment and this embodiment.

Figure 7:
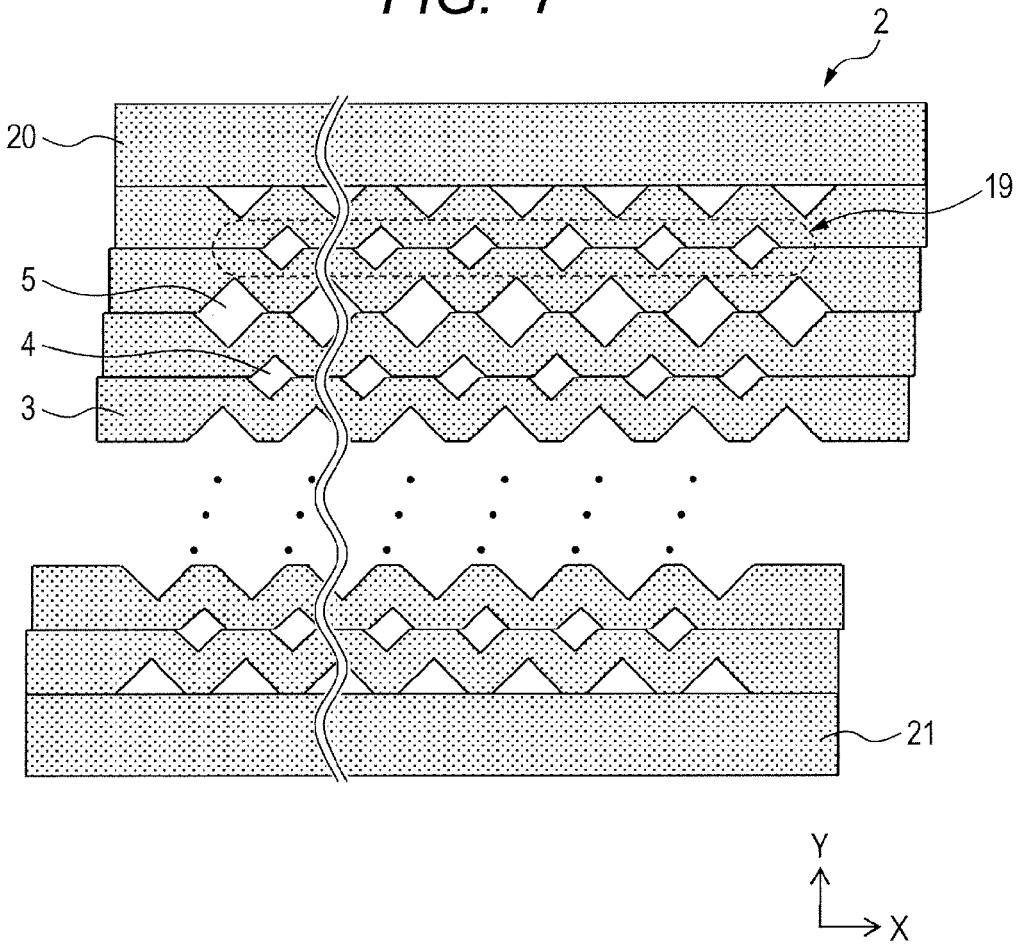
FIG. 7 is a schematic cross-sectional view of the piezoelectric block of the second embodiment of liquid ejection head according to the present invention taken along an X-Y plane.

This embodiment differs from the first embodiment in terms of the configuration of the piezoelectric block 2. FIG. 7 is a schematic cross-sectional view of the piezoelectric block 2 of this embodiment taken along an X-Y plane.

The piezoelectric block 2 of this embodiment is the same as the first embodiment in that the pressure chamber rows 19 are arranged in the Y-direction and adjacent ones of the pressure chamber rows 19 are displaced by a predetermined length in a predetermined direction (in the X-direction) so as to make the positions of the pressure chambers in the pressure chamber rows 19 agree with the positions of the corresponding ejection ports in the ejection port rows 18 formed in the nozzle plate 6. However, while the piezoelectric block 2 of the first embodiment is formed by a plurality of piezoelectric plates 3 whose shapes are slightly different from each other, the piezoelectric block 2 of this embodiment is formed by a plurality of piezoelectric plates 3 whose shapes are the same and identical. More specifically, the piezoelectric plates 3 are laid one on the other in the Y-direction such that adjacent ones of the piezoelectric plates 3 are displaced in a predetermined direction (in the X-direction). As a result, any two first grooves 14 that form a single pressure chamber 4 and any two second groves 15 that form a single opening section 5 are displaced in the X-direction and put together. Therefore, while the shape of the first grooves 14 and that of the second grooves 15 of this embodiment are the same as their counterparts of the first embodiment, the shape of the pressure chambers 4 and that of the opening sections 5 (the cross section of the pressure chambers 4 and that of the opening sections 5 taken along a X-Y plane) are different from their counterparts of the first embodiment. In other words, they are not exact square unlike the first embodiment. Additionally, the ends of the piezoelectric plates 3 are not aligned at the lateral surfaces of the piezoelectric block 2.

If piezoelectric plates 3 having the same shape are employed in this way, by laminating the piezoelectric plates in a manner that they are displaced in a certain direction, the positions of the pressure chambers 4 can be made to agree with the positions of the corresponding ejection ports 7 that are arranged to raise the effective nozzle density as in the first embodiment (see FIG. 1). This arrangement can provide advantages similar to those of the first embodiment while simplifying the machining steps for forming the grooves.

Third Embodiment

Now, the configuration of the third embodiment of liquid ejection head according to the present invention will be described below. In the following description, the components of this embodiment that are the same as or similar to those of the above-described embodiments are denoted by the same reference symbols and will not be described repeatedly. In other words, the third embodiment will be described only in terms of the differences between the preceding embodiments and this embodiment.

Figure 8:
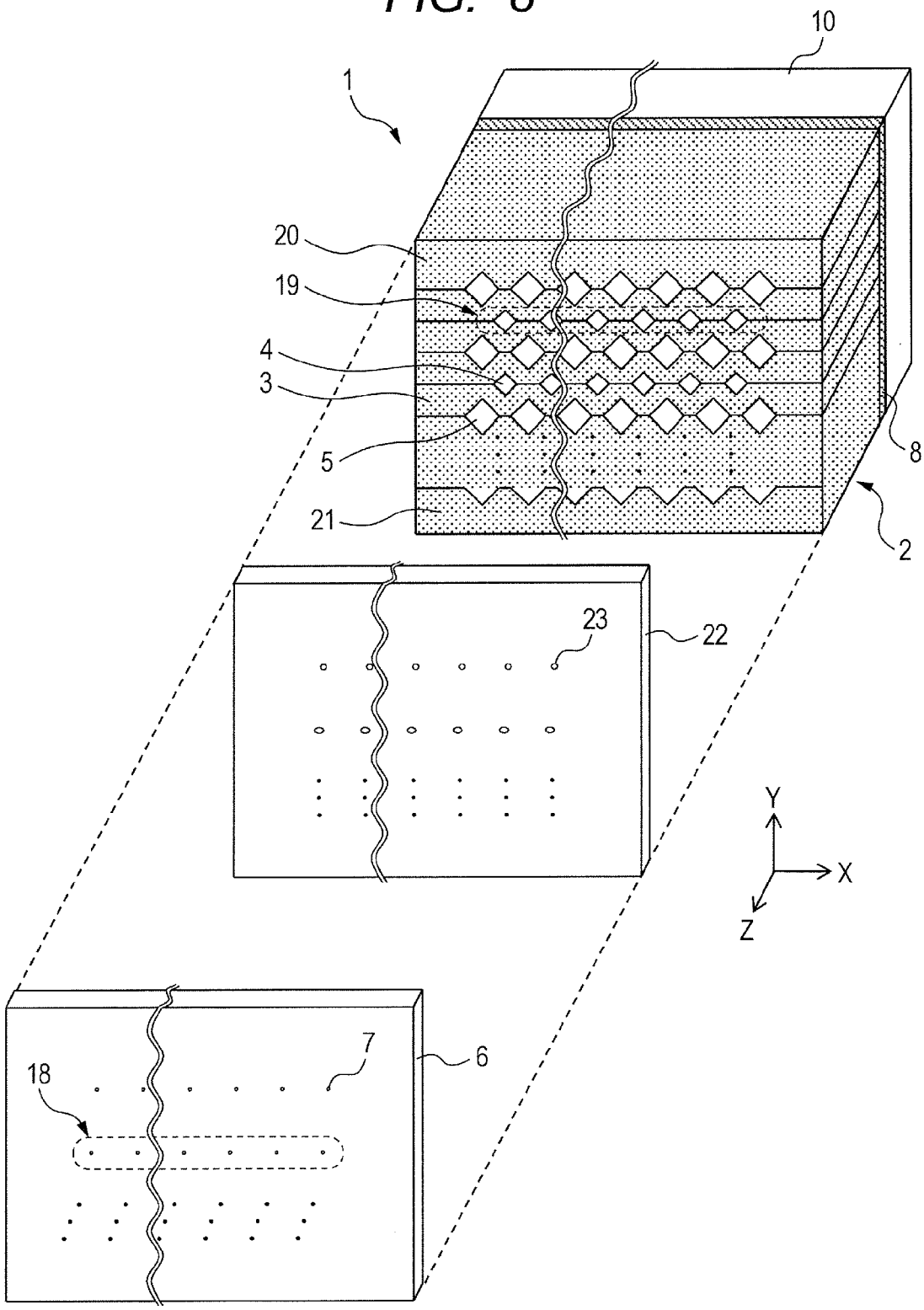
FIG. 8 is a schematic perspective view of the third embodiment of liquid ejection head according to the present invention.
Figure 9:
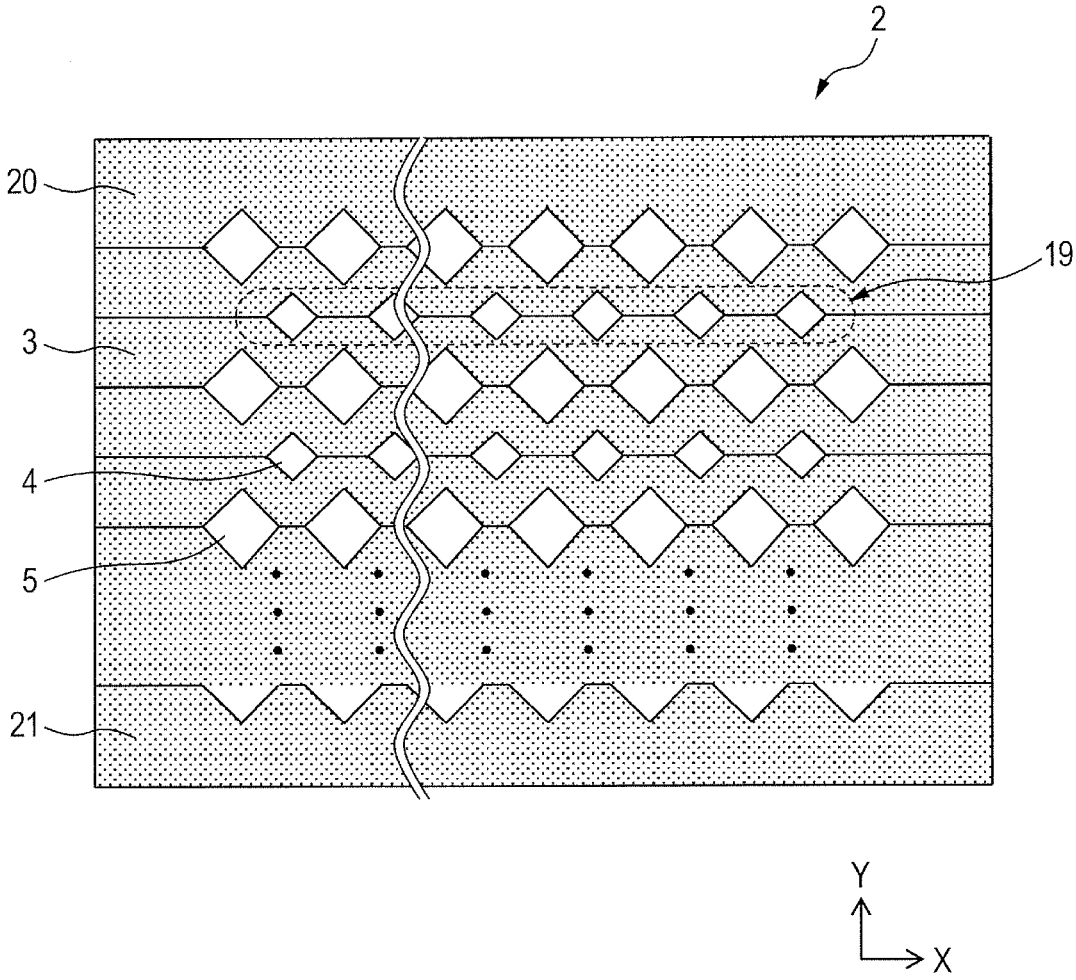
FIG. 9 is a schematic cross-sectional view of the piezoelectric block of the liquid ejection head illustrated in FIG. 8 that is taken along an X-Y plane.
Figure 10:
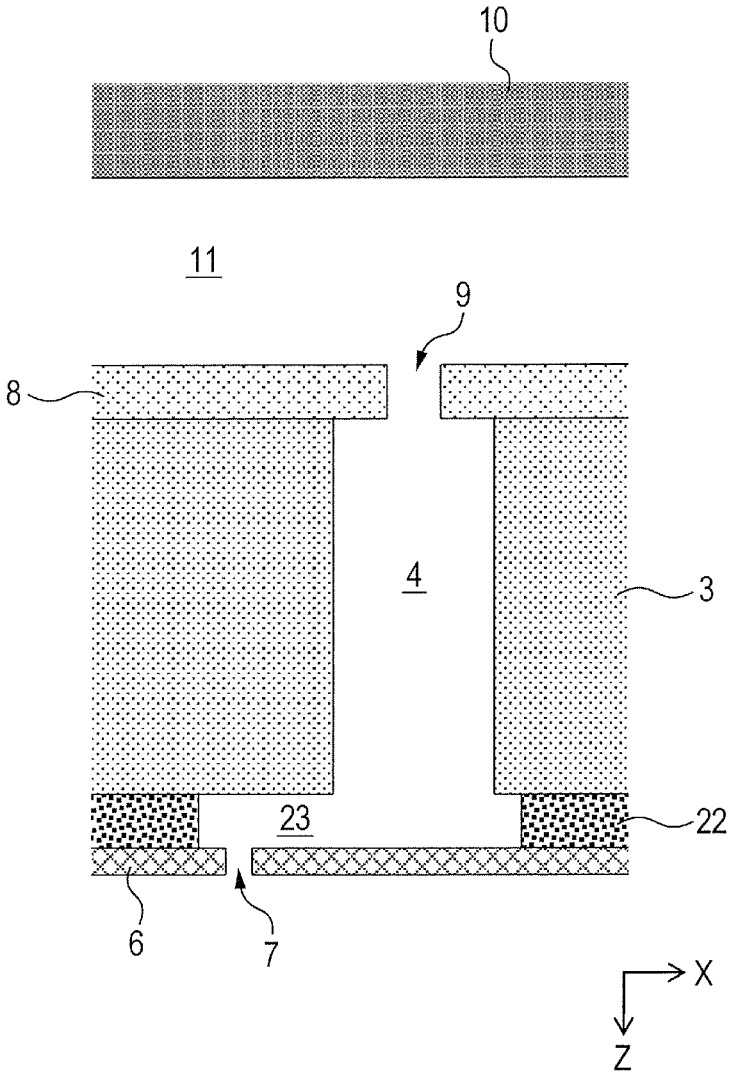
FIG. 10 is a schematic cross-sectional view of the third embodiment of liquid ejection head taken along an X-Z plane.

FIG. 8 is a schematic perspective view of the liquid ejection head 1 of the third embodiment of the invention. FIG. 9 is a schematic cross-sectional view of the piezoelectric block 2 illustrated in FIG. 8 and taken along an X-Y plane. FIG. 10 is a schematic cross-sectional view of the liquid ejection head 1 of this embodiment taken along a Z-X plane. It is an enlarged cross-sectional view of a part that corresponds to a single pressure chamber 4.

Unlike the preceding embodiments, the plurality of pressure chamber rows 19 of this embodiment are not displaced in the X-direction (see FIG. 9). More specifically, while the piezoelectric block 2 of this embodiment are formed by a plurality of piezoelectric plates 3 having the same shape as in the instance of the second embodiment and the plurality of piezoelectric plates 3 are laid one on the other such that they are aligned in the X-direction. As a result, the pressure chambers 4 and the opening sections 5 formed in the piezoelectric block 2 are located at orthogonal grid crossings in an X-Y plane.

On the other hand, the nozzle plates 6 of this embodiment are arranged in the Y-direction such that the ejection port rows 18 are sequentially and gradually displaced by a predetermined length in a certain direction (in the X-direction) in order to raise the effective nozzle density as in the instance of the first embodiment (see FIG. 8). Therefore, in this embodiment, the positions of the ejection ports 7 and the positions of the pressure chambers 4 do not agree in an X-Y plane. Then, as a result, if the piezoelectric block 2 and the nozzle plate 6 are directly bonded to each other as in the case of the preceding embodiments, the center of each of the ejection ports 7 does not agree with the center of the corresponding one of the pressure chambers 4. If the center of each of the ejection ports 7 does not agree with the center of the corresponding one of the pressure chambers 4, a phenomenon where liquid is ejected to represent a trajectory that is warped in an unintended direction occurs when liquid is ejected from any of the ejection ports. Furthermore, if the center of each of the ejection ports 7 is displaced to a large extent from the center of the corresponding one of the pressure chambers 4, and thus, each of the ejection ports 7 does not communicate with the corresponding one of the pressure chambers 4, as a matter of course, the liquid ejection head can no longer eject liquid.

In order to avoid such a problem, a channel plate is provided between the piezoelectric block 2 and the nozzle plate 6 in this embodiment as illustrated in FIG. 8. Connecting channels 23 are formed in the channel plate 22 in order to allow the pressure chambers 4 of the piezoelectric block 2 individually communicate with the respective ejection ports 7 of the nozzle plate 6. With the provision of such connecting channels 23, each of the pressure chambers 4 and the corresponding one of the ejection ports 7 can communicate with each other as illustrated in FIG. 10 if the center of each of the ejection ports 7 does not agree with the center of the pressure chamber 4. Additionally, when liquid is ejected, any misdirection can be prevented from taking place by appropriately designing the profile of the connecting channels 23.

Only piezoelectric plates 3 having the same and identical shape are employed to form the liquid ejection head 1 of this embodiment and the piezoelectric plates 3 do not need to be displaced from each other when laying them one on the other so that the steps for forming the liquid ejection head can be further simplified.

Preferably, the nozzle plate 6 and the piezoelectric block 2 are so arranged that the center of each of the ejection ports 7 and that of the corresponding one of the pressure chambers 4 are displaced in the X-direction in order to prevent the connecting channels 23 and the opening sections 5 from interfering with each other.

Fourth Embodiment

Now, the configuration of the fourth embodiment of liquid ejection head according to the present invention will be described below. In the following description, the components of this embodiment that are the same as or similar to those of the above-described embodiments are denoted by the same reference symbols and will not be described repeatedly. In other words, the fourth embodiment will be described only in terms of the differences between the preceding embodiments and this embodiment.

Figure 11A:
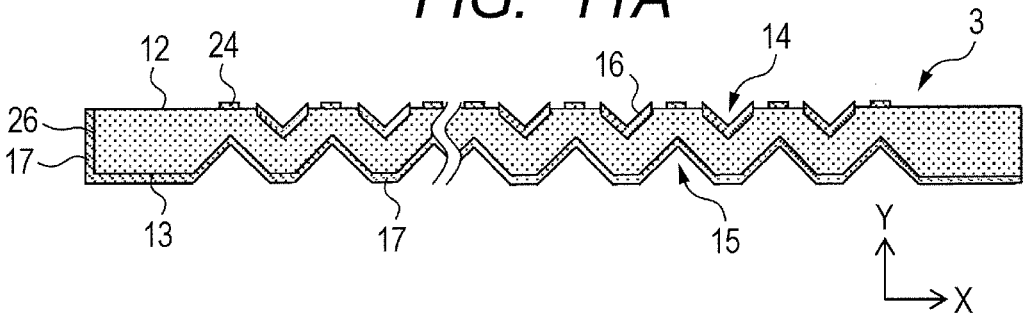
FIGS. 11A, 11B and 11C are a schematic cross-sectional view and schematic perspective views of one of the piezoelectric plates of the piezoelectric block of the fourth embodiment of liquid ejection head according to the present invention.
Figure 11B:
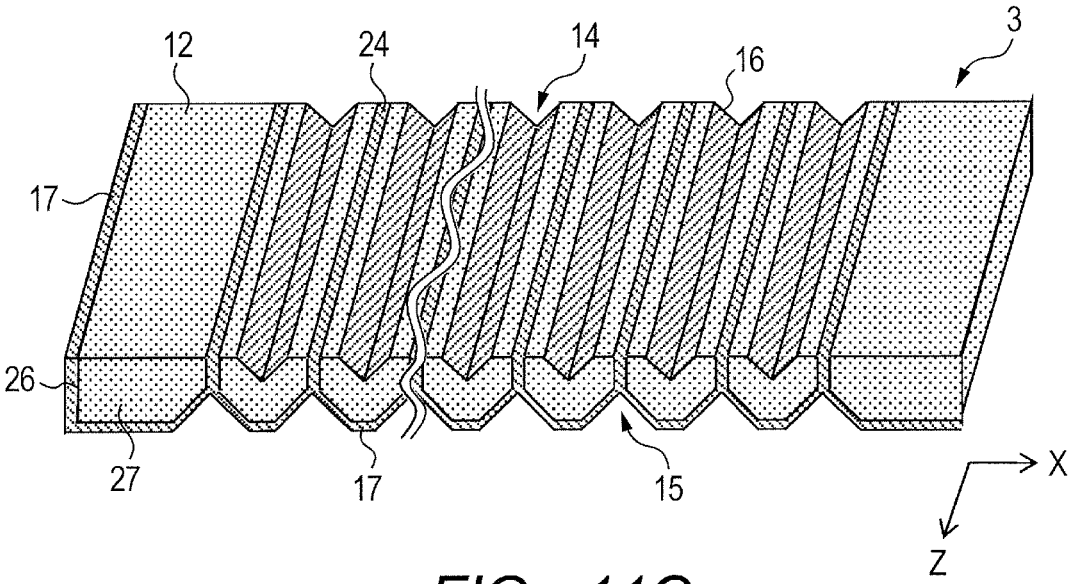
Figure 11C:
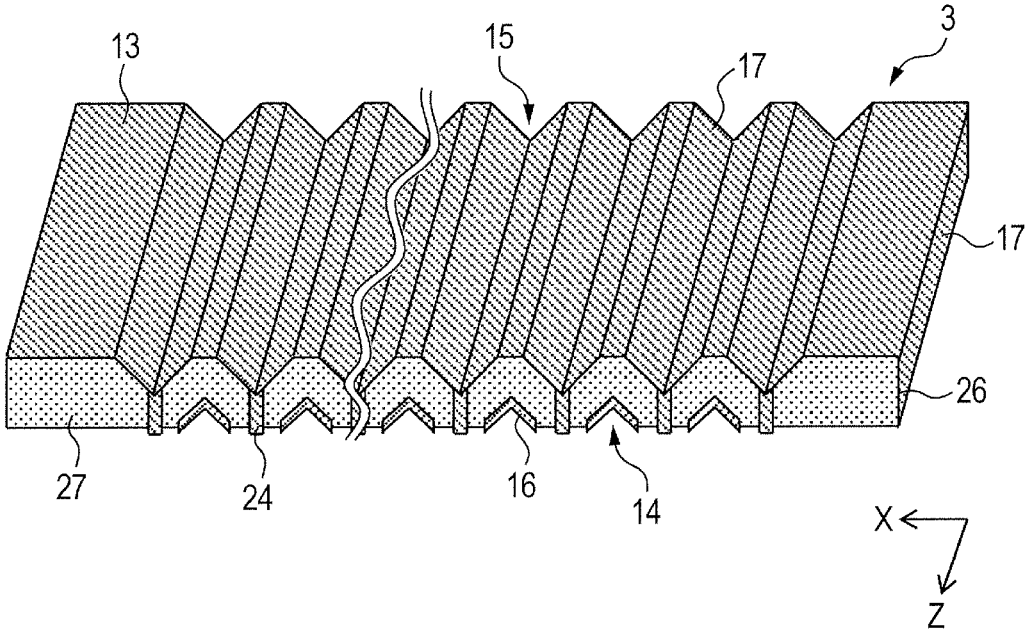

FIGS. 11A through 11C are views illustrating in detail the configuration of one of the piezoelectric plates, or piezoelectric plate 3, of the piezoelectric block of the fourth embodiment of liquid ejection head according to the present invention. FIG. 11A is a schematic cross-sectional view of the piezoelectric plate 3 taken along an X-Y plane. FIG. 11B is a schematic perspective view of the piezoelectric plate 3 as viewed from the side of the first surface 12 thereof. FIG. 11C is a schematic perspective view of the piezoelectric plate 3 as viewed from the opposite side, or the side of the second surface 13 thereof.

As illustrated in FIGS. 11A and 11B, a third electrode 24 that extends in the Z-direction is provided between any two adjacent first grooves 14 on the first surface 12. The third electrodes 24 are independent from the first electrodes. The third electrodes 24 are drawn out to the side of the nozzle plate 6 and connected to the second electrode 17 of the piezoelectric plate 3 on the end facet 27 of the piezoelectric plate 3 located at the side of the nozzle plate 6. The wirings connecting the third electrodes 24 and the second electrodes 17 are formed on the end facet 27 of the piezoelectric plate 3 at the side of the nozzle plate 6 after forming the piezoelectric block 2 by laying all the piezoelectric plates 3 one on the other. Alternatively, the third electrodes 24 and the second electrodes 17 may be connected to each other by wirings formed on the nozzle plate 6 by patterning when the nozzle plate 6 is bonded to the piezoelectric block 2. Otherwise, the configuration of this embodiment is the same and identical with that of the first embodiment.

Figure 12:
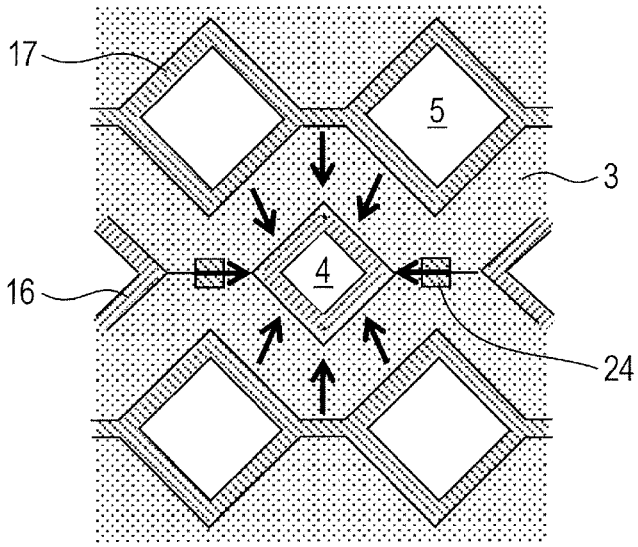
FIG. 12 is an enlarged schematic cross-sectional view of a pressure chamber and its vicinity of the piezoelectric block of the fourth embodiment of liquid ejection head according to the present invention.

FIG. 12 is an enlarged schematic cross-sectional view of a pressure chamber 4 formed by the piezoelectric plates 3 of this embodiments and its vicinity. FIG. 12 also represents the electric field distribution around the pressure chamber 4 when the liquid ejection head is driven to operate.

As an electric field is generated between each of the first electrodes 16 and the adjacent one or two third electrodes 24 in addition to the electric field generated between the first electrodes 16 and the second electrodes 17 of each pair of piezoelectric plates of this embodiment, the deformation of the piezoelectric material around each pressure chamber 4 can be increased. Then, as a result, the drive voltage can be reduced if compared with an arrangement of not using any third electrodes 24.

Fifth Embodiment

Now, the configuration of the fifth embodiment of liquid ejection head according to the present invention will be described below. In the following description, the components of this embodiment that are the same as or similar to those of the above-described embodiments are denoted by the same reference symbols and will not be described repeatedly. In other words, the fifth embodiment will be described only in terms of the difference between the preceding embodiments and this embodiment.

Figure 13:
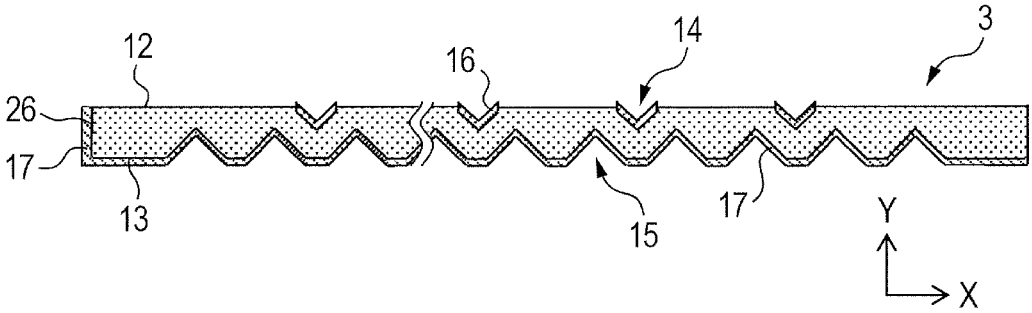
FIG. 13 is a schematic cross-sectional view of one of the piezoelectric plates of the piezoelectric block of the fifth embodiment of liquid ejection head according to the present invention taken along an X-Y plane.

This embodiment differs from the first embodiment in terms of the configuration of the second grooves 14 of the piezoelectric plates. FIG. 13 is a schematic cross-sectional view of one of the piezoelectric plates 3 of this embodiment taken along an X-Y plane.

While a single second groove 15 is formed between two first grooves 14 in the first embodiment as viewed in the Y-direction, two second grooves 15 are formed between two first grooves in this embodiment. Otherwise, the configuration of this embodiment is the same and identical with that of the first embodiment.

This arrangement provides an advantage that, when any two adjacent first grooves 14 are separated from each other by a large gap, the strength of each of the piezoelectric plates 3 can be enhanced if compared with an arrangement where the width of each of the second grooves 14 is increased (see, e.g., FIG. 6).

Sixth Embodiment

Now, the configuration of the sixth embodiment of liquid ejection head according to the present invention will be described below. In the following description, the components of this embodiment that are the same as or similar to those of the above-described embodiments are denoted by the same reference symbols and will not be described repeatedly. In other words, the sixth embodiment will be described only in terms of the difference between the preceding embodiments and this embodiment.

Figure 14A:
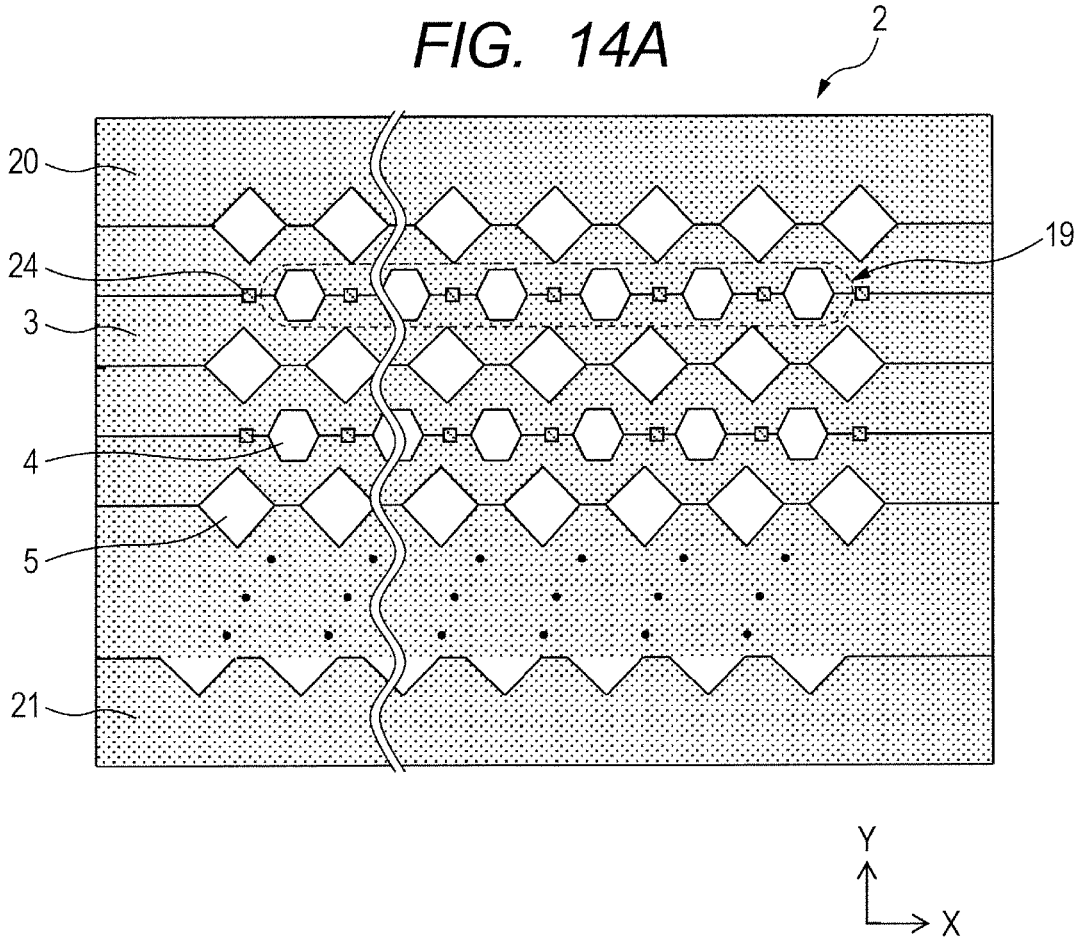
FIGS. 14A and 14B are schematic cross-sectional views of the piezoelectric block of the sixth embodiment of liquid ejection head according to the present invention taken along an X-Y plane.
Figure 14B:
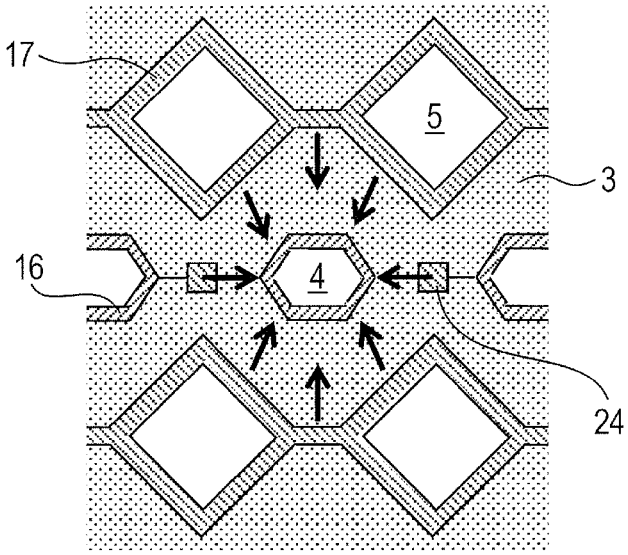

FIG. 14A is a schematic cross-sectional view of the piezoelectric block 2 of the sixth embodiment of liquid ejection head according to the present invention taken along an X-Y plane. FIG. 14B is an enlarged schematic cross-sectional view of one of the pressure chambers 4 of the piezoelectric block 2 and its vicinity. FIG. 14B also represents the electric field distribution around the pressure chamber 4 when the liquid ejection head is driven to operate.

This embodiment is an exemplary modification of the fourth embodiment. Each of the first grooves 14 formed on the piezoelectric plates 3 represents a trapezoidal cross section and hence of each of the pressure chambers 4 represents a hexagonal cross section. Otherwise, the configuration of this embodiment is the same as that of the fourth embodiment.

With this arrangement, if compared with an instance where each of the pressure chambers 4 represents a rectangular cross section (see FIG. 12), the electric field generated around the piezoelectric chamber 4 can be made to be better directed in the directions in which the piezoelectric material around the piezoelectric chamber 4 is deformed (see FIG. 14B). Additionally, the distances separating the electrodes can be made to be more uniform so that the areas where the electrodes are separated by a large distance and hence the areas where the electric field intensity is weak can be reduced. Then, as a result, the piezoelectric material can be made to be more deformable and hence the drive voltage necessary to drive the liquid ejection head can be reduced.

Seventh Embodiment

Now, the configuration of the seventh embodiment of liquid ejection head according to the present invention will be described below. In the following description, the components of this embodiment that are the same as or similar to those of the above-described embodiments are denoted by the same reference symbols and will not be described repeatedly. In other words, the seventh embodiment will be described only in terms of the difference between the preceding embodiments and this embodiment.

Figure 15A:
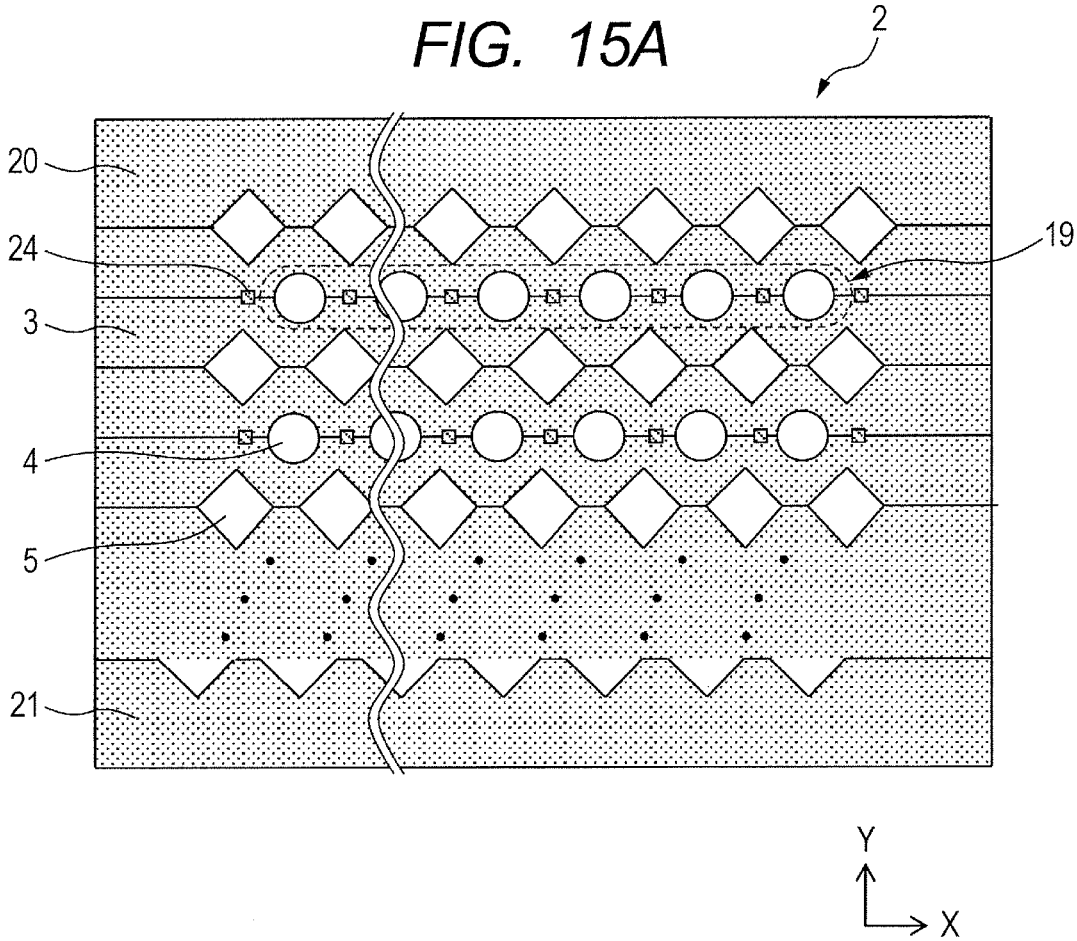
FIGS. 15A and 15B are schematic cross-sectional views of the piezoelectric block of the seventh embodiment of liquid ejection head according to the present invention taken along an X-Y plane.
Figure 15B:
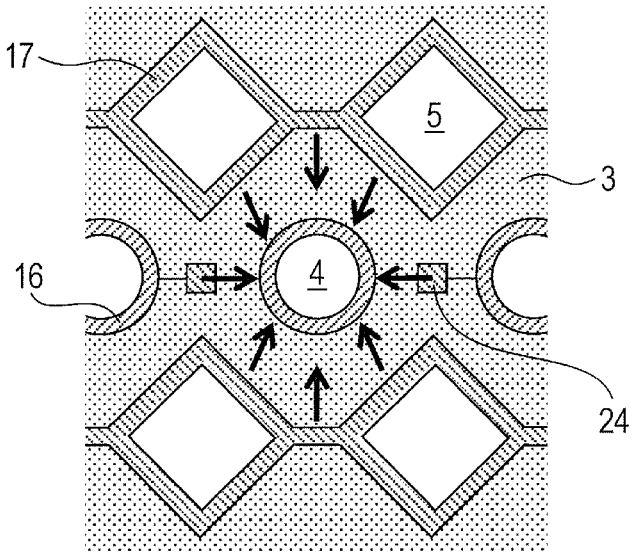

FIG. 15A is a schematic cross-sectional views of the piezoelectric block 2 of the seventh embodiment of liquid ejection head according to the present invention taken along an X-Y plane. FIG. 15B is an enlarged schematic cross-sectional view of one of the pressure chambers 4 of the piezoelectric block 2 and its vicinity. FIG. 15B also represents the electric field distribution around the pressure chamber 4 when the liquid ejection head is driven to operate.

Like the sixth embodiment, this embodiment is an exemplary modification of the fourth embodiment. Each of the first grooves 14 formed on the piezoelectric plates 3 represents a semicircular cross section and hence each of the pressure chambers 4 represents a circular cross section. Otherwise, the configuration of this embodiment is the same as that of the fourth embodiment.

With this arrangement, if compared with an instance where each of the pressure chambers 4 represents a rectangular cross section (see FIG. 12) and an instance where each of the pressure chambers 4 represents a hexagonal cross section (see FIG. 14B), the electric field generated around the pressure chamber 4 can be made to be even better directed in the directions in which the piezoelectric material around the pressure chamber 4 is deformed (see FIG. 15B). Additionally, the distances separating the electrodes can be made to be more uniform so that the areas where the electrodes are separated by a large distance and hence the areas where the electric field intensity is weak can be reduced. Then, as a result, the piezoelectric material can be made to be more deformable and hence the drive voltage necessary to drive the liquid ejection head can be reduced further. Furthermore, since the wall surfaces of the pressure chambers 4 are curved surfaces with this arrangement, air bubbles can hardly be retained on the wall surfaces.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-140844, filed on Jun. 22, 2012, which is hereby incorporated by reference herein in its entirety.

What is claimed is:

1. A liquid ejection head comprising:

a plurality of pressure chambers communicating with respective ejection ports for ejecting liquid and arranged to store liquid to be ejected from the ejection ports, the wall section of each of the pressure chambers being formed by means of a piezoelectric material; and a plurality of hollow spaces arranged around the pressure chambers and separated from the pressure chambers by gaps, wherein the pressure chambers and the hollow spaces are formed in a piezoelectric block produced by laminating a plurality of piezoelectric plates made of a piezoelectric material, a plurality of first grooves being formed on a first surface of each of the piezoelectric plates so as to extend in a first direction, a plurality of second grooves being formed on a second surface opposite to the first surface of each of the piezoelectric plates so as to extend in the first direction;

the plurality of piezoelectric plates are laminated so as to put the first surfaces or the second surfaces of adjacent piezoelectric plates into contact with each other such that the pressure chambers are formed as the first grooves of the paired first surfaces that are held in contact with each other are placed vis-a-vis, and the hollow spaces are formed as the second grooves of the paired second surfaces that are held in contact with each other are placed vis-a-vis; and first electrodes are formed in the first grooves, second electrodes are formed in the second grooves.

2. The liquid ejection head according to claim 1, wherein the first grooves and the second grooves are displaced from each other as viewed in the direction of lamination of the laminated body of the piezoelectric block.

3. The liquid ejection head according to claim 2, wherein the first grooves and the second grooves are arranged alternately as viewed in the direction of lamination of the laminated body of the piezoelectric block.

4. The liquid ejection head according to claim 1, wherein the second electrodes are linked to each other on the second surface.

5. The liquid ejection head according to claim 1, wherein a third electrode is formed between any adjacent first grooves at least on one of each pair of first surfaces that are held in contact with each other so as to extend in the first direction, the third electrodes being independent from the first electrodes.

6. The liquid ejection head according to claim 1, wherein each of the second grooves represents a triangular cross section when taken in a direction orthogonal to the first direction.

7. The liquid ejection head according to claim 1, wherein each of the second grooves represents a trapezoidal cross section when taken in a direction orthogonal to the first direction.

8. The liquid ejection head according to claim 1, wherein each of the first grooves represents a triangular cross section when taken in a direction orthogonal to the first direction.

9. The liquid ejection head according to claim 1, wherein each of the first grooves represents a trapezoidal cross section when taken in a direction orthogonal to the first direction.

10. The liquid ejection head according to claim 1, wherein each of the first grooves represents a semicircular cross section when taken in a direction orthogonal to the first direction.

* * * * *